US007000265B2

(12) United States Patent
Faisst

(10) Patent No.: US 7,000,265 B2
(45) Date of Patent: Feb. 21, 2006

(54) SHOWERHEAD HOLDER

(75) Inventor: Magdalena Faisst, Schiltach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/735,565

(22) Filed: Dec. 12, 2003

(65) Prior Publication Data

US 2004/0172748 A1 Sep. 9, 2004

(30) Foreign Application Priority Data

Dec. 13, 2002 (DE) ..... 102 60 203

(51) Int. Cl.
*A47K 3/20* (2006.01)

(52) U.S. Cl. ..... 4/570; 4/615

(58) Field of Classification Search ..... 4/567–570, 4/615

See application file for complete search history.

(56) References Cited

U.S. PATENT DOCUMENTS

D291,912 S * 9/1987 Fabian ..... D23/283
2004/0049843 A1 * 3/2004 Glunk ..... 4/567

FOREIGN PATENT DOCUMENTS

| | | |
|---|---|---|
| DE | 7908437 U1 | 8/1979 |
| DE | 8506749 U1 | 6/1985 |
| DE | 1 96 50 000 | 6/1998 |

OTHER PUBLICATIONS

Copy of European Search Report.
Copy of German Search Report.

* cited by examiner

*Primary Examiner*—Charles E. Phillips
(74) *Attorney, Agent, or Firm*—Duane Morris LLP

(57) ABSTRACT

An arrangement for attaching a showerhead holder such that its height will be adjustable incorporates a wall-mounting rail having a central, forward-facing groove for attaching a showerhead holder such that its height will be adjustable on its front surface. An auxiliary groove that may be engaged by accessory items and a wall bracket that is intended for attaching the wall-mounting rail to the wall is situated on either side of that groove.

19 Claims, 4 Drawing Sheets

SHOWERHEAD HOLDER

Figure 2:
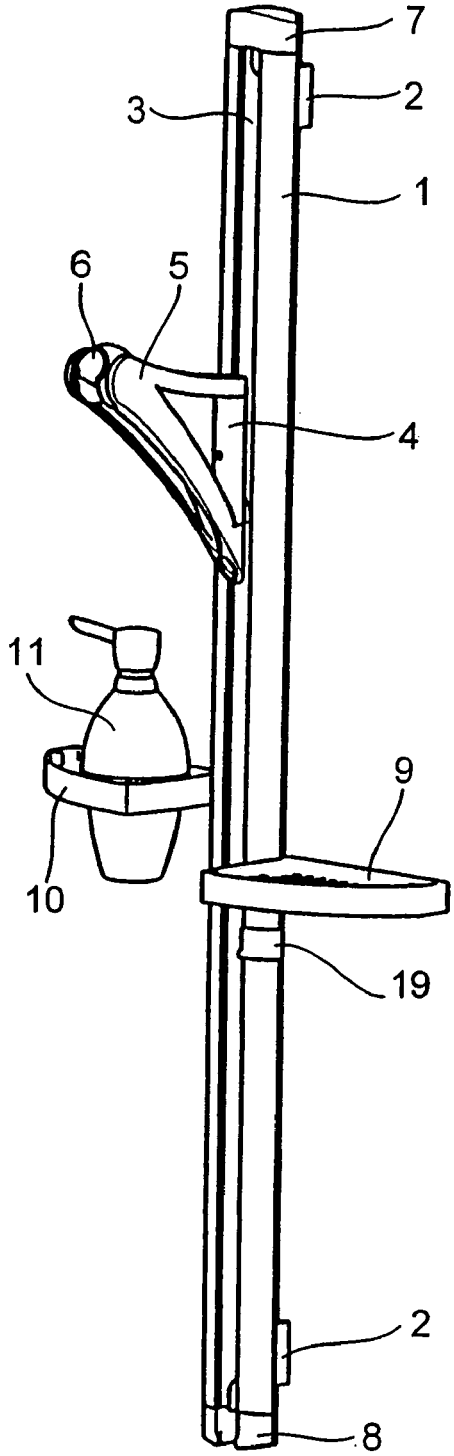

The invention is based on an arrangement for attaching a showerhead such that its height will be adjustable. Known for this purpose are vertical wall-mounting rods that are either mounted before a wall or on a wall and have a guide, along which a holder for a showerhead may be slid. The showerhead may usually be removed from the holder and is connected to the building's water system by a shower hose. The holder has facilities for pivoting the showerhead about a horizontal axis. In many cases, the holder may also be pivoted about a vertical axis, either the longitudinal axis of the wall-mounting rod or, in the event that the wall-mounting rod is a length of profiled stock, about an axis parallel to the guide.

It is also known that accessory items, for example, holders for liquid soap, brushes, or similar, that users need, or would like to have available, during showering may be attached to wall-mounting rods. These accessory items are attached to, for example, a console on the bottom end of wall-mounting rods in order that they will be positioned at a fixed height. If such accessory items are to be attached such that their heights will be adjustable, and if the same profiled guide used for the attaching the showerhead holder is to be employed, the travel of the showerhead holder will, of course, be restricted.

The problem addressed by the invention is creating an arrangement for attaching an adjustable showerhead holder and at- least one other accessory item, where the other accessory item will not restrict the adjustment range of the showerhead holder.

The invention as disclosed and claimed herein solves this and other problems.

The auxiliary guide involved may be a rod mounted parallel to the wall-mounting rod that need not provide the same adjustment range as the wall-mounting rod for the shower-head holder.

Under an elaboration on the invention, it may be provided that the auxiliary guide is aligned parallel to the guide for the showerhead holder.

Under an elaboration on the invention, it may be provided that the configuration and the shape of the cross-section of the auxiliary guide be identical to those of the guide for the showerhead holder, where it may have the same length, which, however, is not required. For example, the adjustment range chosen for a storage tray may differ, since the storage tray does not need to be attached as high as the holder for a showerhead, which, of course, if it is to be used as an overhead showerhead, should be attached at a height exceeding the user's height.

If the configuration of the auxiliary guide is identical to that of the guide for the showerhead holder, the auxiliary guide may be employed for attaching the same items as the primary guide, and may even be employed as a guide for a second showerhead; in which case, the same holder may be employed.

However employing an auxiliary guide that has a different configuration than that of the guide for the shower-head holder will also be feasible, and is covered by the invention, where "different configuration" may be interpreted either as a differently shaped cross-section or a different length. Even if it has a different configuration, the auxiliary guide may, if desired, still be employed for attaching a second showerhead, where the second showerhead may, if desired, differ from the first. Attaching several showerheads having differing functions to the various guides will also be feasible. For example, side-mounted showerheads may be guided on the auxiliary guides, particularly if the wall-mounting rod is composed of two sections, since the heights of the side-mounting showerheads will usually not need to be adjusted over the full adjustment range of the primary showerhead. Since the auxiliary guide is primarily intended for accommodating accessory items that are to be treated differently than the showerhead holder, according to the invention, the auxiliary guide may be adapted to suit the various treatments of the accessory items to be involved. For example, the adjustment ranges of accessory items need not be the same as that for the primary guide. On the other hand, the type of adjustment involved may be configured differently, since the heights of accessory items will not need to be varied as frequently, if at all. Furthermore, several hygienic items, which will then limit one another's travels, may be accommodated on the auxiliary guide. However, this might also be intentional, or at least present no problems, under some circumstances. A storage tray will usually be attached at a lower level than a holder for a shampoo bottle.

Since the primary guide is intended for the shower-head holder, according to an elaboration on the invention, it may be provided that this guide for the shower-head holder faces forward, while the auxiliary guide is both arranged to one side and faces sideward, which, in the case of a wall-mounting rod configured in the form of a length of profiled stock, may be arranged by providing that the guide is correctly oriented facing sideward, for example, under an elaboration, in the vicinity of the rear face of the wall-mounting profiled rod.

Under an elaboration on the invention, it may be provided that the guide for the showerhead holder and/or the auxiliary guide is configured such that it/they has/have a groove, preferably an undercut groove. The undercut will allow a particularly simple means for retaining the holders for the respective items to be involved.

In order to be able to even better adapt the arrangement to suit the habits and needs of users, according to an elaboration on the invention, it may be provided that the wall-mounting rod or wall-mounting rail has a pair of auxiliary guides that are preferably symmetrically arranged and configured with respect to the guide for shower-head holder. An on-site adaptation to suit, for example, left-handers, may then be effected, where even users themselves may decide whether they wish to attach their accessory items to the left-hand or right-hand side of the rod or rail.

Installing a pair of auxiliary guides may, of course, also allow solving the aforementioned problem, namely, that two accessory items have to share their adjustment ranges if a single guide only is present.

In order to install the wall-mounting rod or wall-mounting rail, it may, of course, in the simplest case, be screwed onto the wall using screws inserted through openings in the rod or rail. However, an elaboration on the invention proposes that a wall bracket, to which the wall-mounting rod may be attached once the bracket has been screwed onto the wall, may be employed for installing the wall-mounting rod. Employment of a wall bracket will make the mountings on the wall virtually invisible. Under an elaboration on the invention, it may then be provided that the wall bracket is configured such that it will not interfere with adjustments of the showerhead holder. In particular, it may be provided that the wall bracket may be attached to the wall-mounting rod at an arbitrary location along its length, which will allow fastening the wall bracket to the wall at the same location thereon where a wall bracket had formerly been attached, following renovations. There will thus be no holes that had been drilled at an earlier date that will have to be subsequently filled in remaining anywhere on the wall.

A particularly suitable opportunity for these achieving these goals proposed by the invention involves the wall bracket engaging at least one auxiliary guide, preferably both auxiliary guides, which, although it will restrict the adjustment ranges for the accessory items to be involved, will represent no true adverse effect thereon, since, as stated earlier, the adjustment ranges for accessory items do not need to be very extensive anyhow.

According to the invention, the wall bracket may be configured such that it is attached at the location where two sections of the wall-mounting rod are joined such that it aligns and fastens both sections of the wall-mounting rod, which will allow assembling a wall-mounting rod or wall-mounting rail from several components that may then be joined such that they form, or continue to form, a continuous guide for the shower-head holder.

According to the invention, the guide groove for the showerhead holder may simultaneously accommodate the shower hose. A clamp may also provide that the shower hose remains in the guide. This clamp may be inserted into an auxiliary guide.

Figure 1:
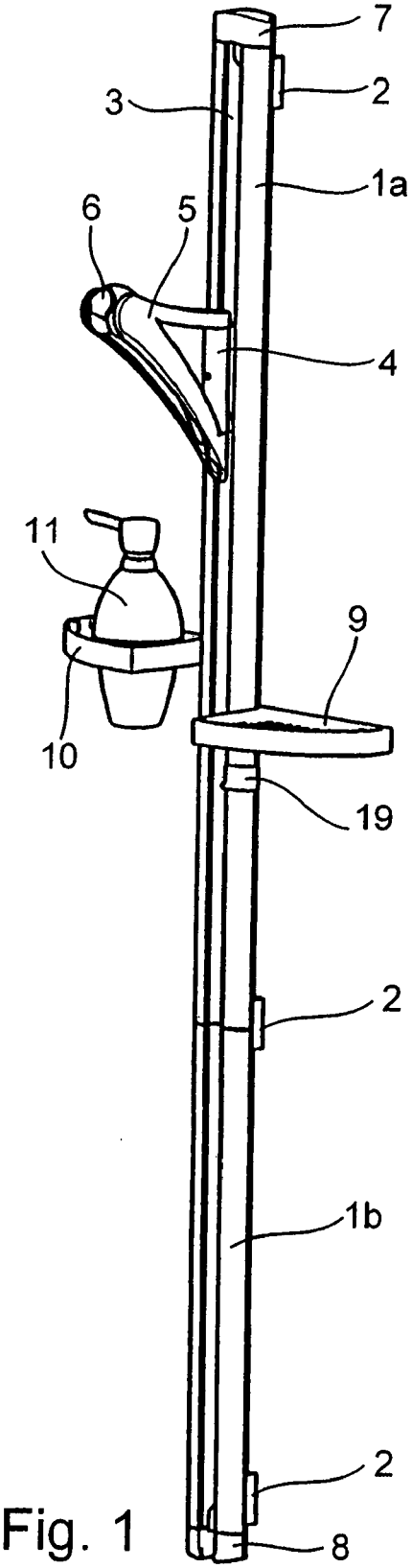
Figure 3:
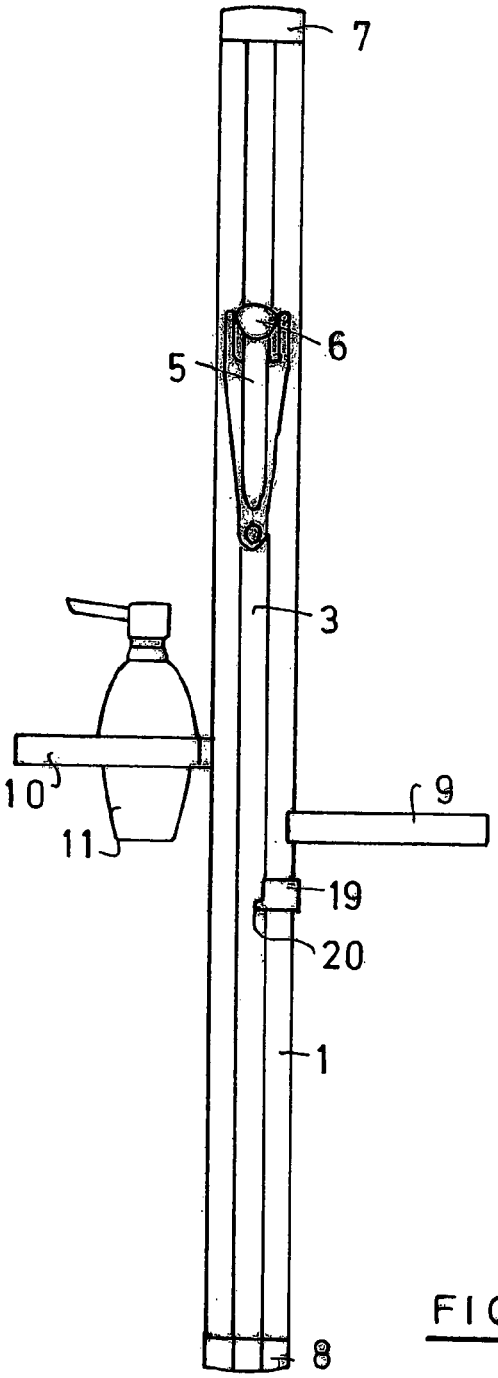
Figure 4:
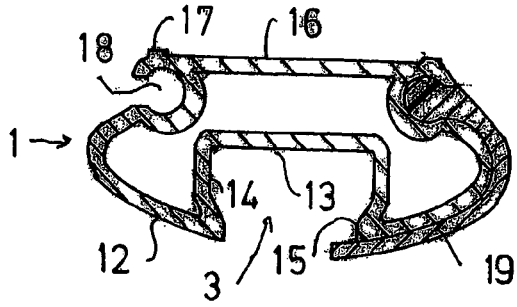
Figure 5:
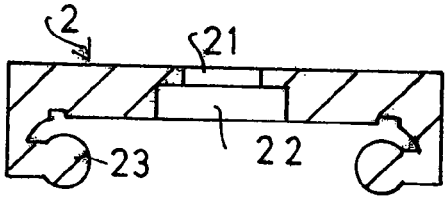
Figure 6:
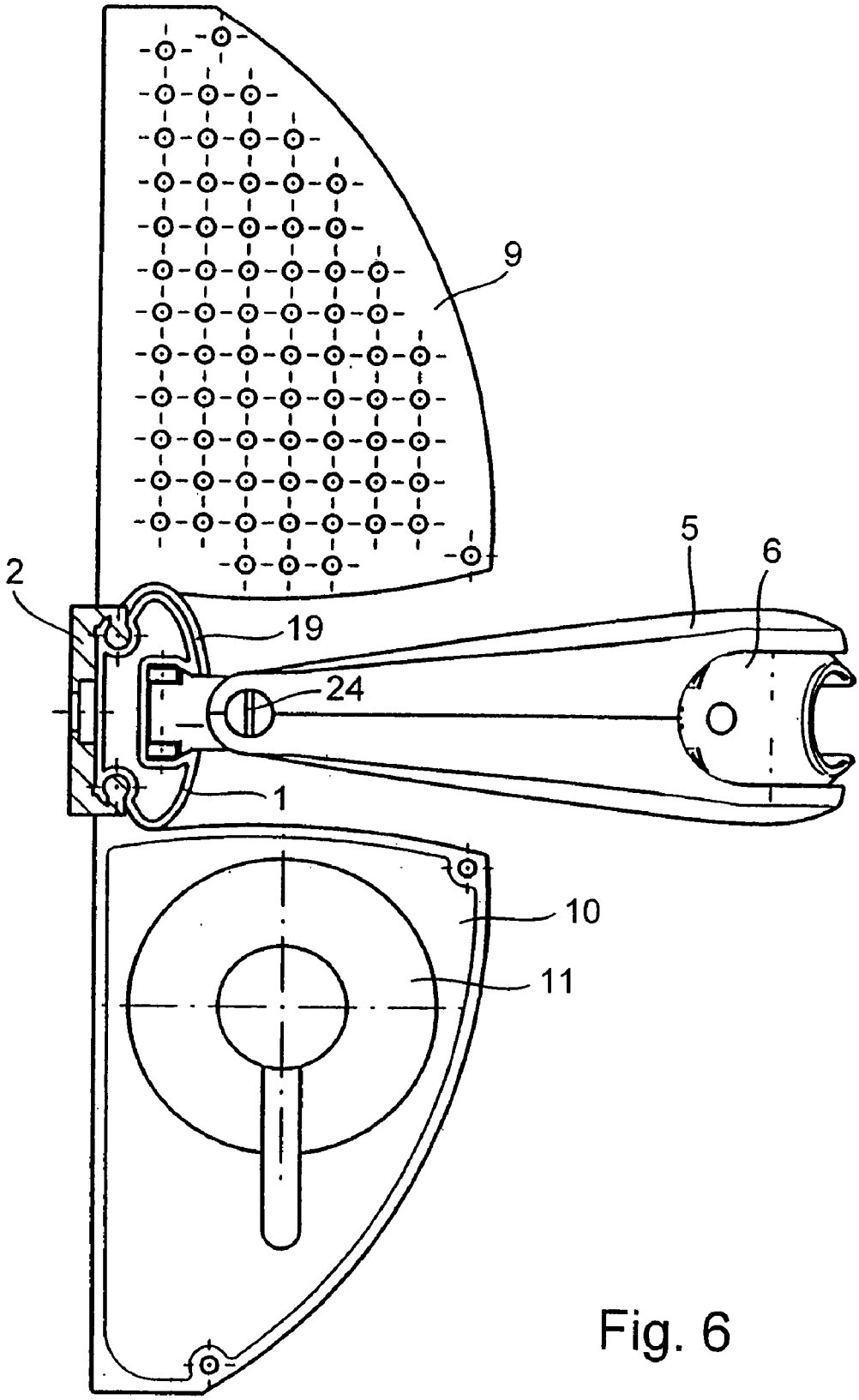
Figure 7:
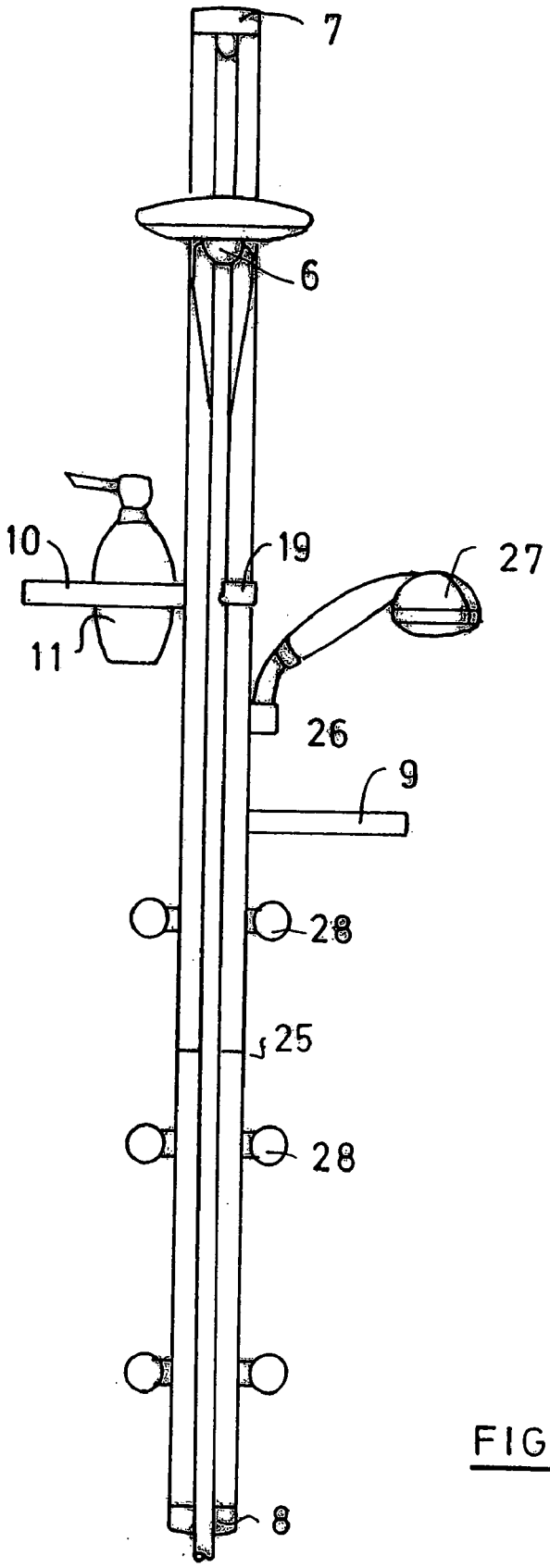

Other features, details, and benefits of the invention are as stated in the claims and the abstract, the wordings of both of which are herewith made part of the content of the description by way of reference thereto, and the following description of a preferred embodiment of the invention, and as shown in the accompanying figures, which depict:

FIG. 1 a view of an arrangement for a hand-held shower head such that its height will be adjustable;

FIG. 2 an arrangement corresponding to that of FIG. 1, except that in FIG. 1 the extended wall-mounting rod is assembled from two sections;

FIG. 3 a frontal view of the arrangement shown in FIG. 1;

FIG. 4 a sectioned view of the arrangement shown in FIG. 3, drawn on a larger scale;

FIG. 5 a sectioned view of a holder for a wall-mounting rod, sectioned in the horizontal plane;

FIG. 6 a top view of the arrangement shown in FIG. 3, drawn on a larger scale;

FIG. 7 a frontal view of an arrangement similar to that shown in FIG. 3.

FIGS. 1 and 2 show embodiments of the wall-mounting rod with height adjustment structures according to the invention. FIG. 2 depicts a wall-mounting rod 1 having a profiled shape fastened to a wall using a pair of holders 2. The wall-mounting rod 1 has a continuous groove 3, extending from top to bottom, on its front surface, i.e., that surface that faces away from the wall. A slide 4 that may be held in position by, for example, friction or a restraining element, is inserted into the groove such that it may be slid along the groove. A holder 5 that has a receptacle 6 for the grip of a hand-held showerhead in the vicinity of its free end is attached to the slide 4. The receptacle 6 is pivotable about a horizontal axis. The holder 5 may be slid along the entire length of the groove 3, from its upper end, which is defined by a cap 7, to its lower end, where a different cap 8 is present, using the slide 4. The cap 8 incorporates an extension of the groove 3.

FIG. 1 depicts an embodiment where the wall-mounting rod 1 consists of two sections, namely, an upper section 1*a* and a lower section 1*b*. In this case, three holders 2, where the central holder 2 is arranged exactly at the joint of the two sections of the wall-mounting rod in order that both the integrity of the joint and the alignment of both sections will be guaranteed, fasten the rod to the wall.

In both figures, a storage tray 9, which is arranged in a guide, whose purpose shall be explained below, is attached to the wall-mounting rod 1, rightward of the groove 3. The storage tray 9 may be slid upward in the guide, without interfering with the slide 4 in the groove 3.

A holder 10 for a shampoo bottle 11 whose height is also adjustable without interfering with adjustments of the holder 5 is attached leftward of the groove 3, and thus leftward of the holder 5 for the hand-held showerhead.

The same elements are substantially present in the case of the embodiments shown in both FIG. 1 and FIG. 2.

FIG. 3 depicts the frontal view of the arrangement shown in FIG. 1. Here, it may be more clearly seen than in FIG. 1 that the three elements held and guided on the wall-mounting rod 1, namely, the holder 5 for the hand-held showerhead, the storage tray 9, and the holder 10 for the shampoo bottle 11, will not interfere with one another when they are adjusted.

FIG. 4 depicts a sectioned view of the length of profiled stock forming the wall-mounting rod 1. Involved here is a length of hollow, profiled stock that has an undercut groove 3 used for guiding the slide 4 (cf. FIG. 1) on a convexly curved front surface 12. The undercut groove 3 has a planar base 13, two sidewalls 14 at right angles to its base, and two undercuts 15.

The length of profiled stock has rear surface 16 opposite its front surface 12 that is planar and bounded down its sides by flat strips 17. The profiling of the wall-mounting rod 1 incorporates a pair of undercut grooves 18 immediately adjacent to its rear surface 16. Each of these undercut grooves 18 forms a guide for the accessory items shown in the figures, where these grooves may, of course, also be used for guiding other accessory items. The pair of guides 18 face sideward, i.e., the slots leading into the guides are oriented at right angles to the front surface of the wall-mounting rod. The guides 18 are arranged such that their separation is less than the maximum width of the profiled wall-mounting rod in order that the guides will be invisible from the front (cf. FIG. 3).

A clasp 19 that may, for example, consist of a plastic, while the length of profiled stock forming the wall-mounting rod 1 may consist of metal, is inserted into the right-hand guide 18. This clasp 19 extends slightly beyond the edge of the slot leading into the groove 3 in order that a hose inserted into the groove 3 will be held in place by the tip 20 of the clasp 19.

FIG. 5 depicts a sectioned view of a wall bracket 2, drawn to a larger scale than that of FIG. 4. The wall bracket 2 incorporates at least one through hole 21, which, in the case of the example shown, is surrounded by a counterbore 22. A screw is inserted through the hole 22 in order that the wall bracket may be screwed onto the wall. The wall bracket has a mating surface matching the contour of that surface of the length of profiled stock forming the wall-mounting rod 1 that faces the wall. Its pair of opposing lobes 23 thus engage the guides 18, thereby fastening the holder 2 to the profiled wall-mounting rod 1. If the length of the wall bracket, i.e., its extension normal to the sectioning plane of FIG. 5, is sufficient, it may also be used for joining two sections of a wall-mounting rod in the manner shown in FIG. 2.

Since the wall bracket 2 may be attached to the profiled wall-mounting rod 1 at virtually any location thereon, it may be screwed onto the wall using existing holes following renovation work.

FIG. 6 depicts another sectioned view of the arrangement shown in FIG. 1 that includes a top view of the accessory items attached to the wall-mounting rod 1. The tray 9 engages the guide 18 at a point beneath the wall bracket 2. The tray is designed such that it extends behind the profiled rod and abuts against the rear surface of the profiled rod. The tray has a lobe 23 having a shape similar to those on the holder 2 that engages the guide groove 18. This lobe may also have a certain longitudinal extension in order that it will provide good guidance and retention of the tray 9. This lobe may be a force fit in the guide groove 18 in order that the tray 9 will be self-locking.

The holder 10 for the shampoo bottle 11 is attached to the guide groove 18 in the same manner.

The slide 4 for the showerhead holder 5 may, for example, be guided in the groove 3 on guide rollers. FIG. 6 shows that the holder 5 may be pivoted about a vertical axis, which is indicated by a screw head 24.

FIG. 7 depicts the frontal view of a shower arrangement where the wall-mounting rod is assembled from two joined sections. As in the case of the foregoing embodiments, a tray 9 and a holder for a shampoo bottle are attached to the guides arranged to the right and left of the profiled rod, respectively.

A holder 26 for a hand-held showerhead 27 is attached to the right-hand auxiliary guide at a location above the joint 25. For simplicity, the hose supplying water thereto has not been shown.

Side-mounted showerheads 28 whose supply lines have not been shown for simplicity are attached to the auxiliary guides at locations below the height of the tray 9. These side-mounting showerheads 28 either need short adjustment ranges only or do not need to be adjusted at all, since the normal holder 6 and its associated showerhead are available for providing an overhead source of running water for showering.

What is claimed is:

1. An arrangement for attaching a showerhead holder in such a way that its height will be adjustable, comprising a wall-mounting longitudinal element in the form of one of a rod and a wall-mounting rail, a showerhead holder that may be slid along the wall-mounting element, a guide for guiding the showerhead holder along the wall mounting element, and at least one auxiliary guide another holder besides the showerhead holder, said auxiliary guide being independent of the primary guide and said another holder being slidable independently of the showerhead holder along the auxiliary guide over a same sliding range as the showerhead holder.

2. An arrangement according to claim 1, wherein at least one said auxiliary guide is aligned parallel to the guide for the showerhead holder.

3. An arrangement according to claim 1, wherein at least one said auxiliary guide has a shape that is identical to a shape of the guide for the showerhead holder over at least part of respective lengths of the guide and the auxiliary guide.

4. An arrangement according to claim 1, wherein at least one said auxiliary guide has a shape that is different from a shape of the guide for the showerhead holder.

5. An arrangement according to claim 1, wherein the guide for the showerhead holder faces forward and at least one said auxiliary guide faces sideward.

6. An arrangement according to claim 1, wherein at least one said auxiliary guide is arranged on a rear surface of the wall-mounting longitudinal element.

7. An arrangement according to claim 1, wherein at least one of the guide for the showerhead holder and the at least one said auxiliary guide is configured to form at least one groove.

8. An arrangement according to claim 1, comprising a pair of said auxiliary guides.

9. An arrangement according to claim 1, further comprising at least one wall bracket for attaching the wall-mounting element to a wall.

10. An arrangement according to claim 9, wherein the wall bracket is configured such that it will not interfere with adjustments of the showerhead holder along the sliding range.

11. An arrangement according to claim 9, wherein the wall bracket is configured for attachment to the wall-mounting element anywhere along the wall mounting element.

12. An arrangement according to claim 9, wherein the wall bracket engages in at least one said auxiliary guide.

13. An arrangement according to claim 9, wherein the wall bracket is designed to join two aligned sections of the wall-mounting element.

14. An arrangement according to claim 1, where the guide groove is configured as a groove sized to accommodate a shower hose.

15. An arrangement according to claim 1, wherein at least one said auxiliary guide is arranged in a vicinity of a rear surface of the wall-mounting longitudinal element.

16. An arrangement according to claim 7, wherein the at least one groove is undercut.

17. An arrangement according to claim 8, wherein the pair of said auxiliary guides are symmetrically arranged with respect to the guide for the showerhead holder.

18. An arrangement according to claim 9, comprising two said auxiliary guides and wherein the wall bracket engages in both said auxiliary guides.

19. A height adjustable mounting arrangement for a showerhead holder, comprising:

a wall-mountable longitudinal element;

a primary guide extending along at least part of the wall mountable longitudinal element, the primary guide defining a height adjustment range;

a showerhead holder carried by the primary guide and arranged to slide along the wall-mounting element over the height adjustment range;

at least one auxiliary guide extending along the wall mountable longitudinal element and defining a height adjustment range, an additional holder besides the showerhead holder, wherein said auxiliary guide is independent of the primary guide and arranged for the additional holder to be slidable independently of the primary guide for the showerhead holder, along at least part of the auxiliary height adjustment range of the additional holder that overlaps the height adjustment range of the shower head;

wherein the primary guide and the auxiliary guide are arranged such that the showerhead holder and the additional holder can pass by one another in sliding along their respective height adjustment ranges.

* * * * *